US007510586B2

(12) United States Patent
Boddy et al.

(10) Patent No.: US 7,510,586 B2
(45) Date of Patent: Mar. 31, 2009

(54) DUST SEPARATOR AND COLLECTOR ARRANGEMENT FOR SUCTION CLEANER

(75) Inventors: Andrew David Boddy, Worcester (GB); Christopher Thomas Elsworthy, Cheltenham (GB); Gavin Burnham, Birmingham (GB)

(73) Assignee: Vax Limited (GB)

( * ) Notice: Subject to any disclaimer, the term of this patent is extended or adjusted under 35 U.S.C. 154(b) by 561 days.

(21) Appl. No.: 10/537,381

(22) PCT Filed: Dec. 2, 2003

(86) PCT No.: PCT/GB03/05192

§ 371 (c)(1),
(2), (4) Date: Nov. 14, 2005

(87) PCT Pub. No.: WO2004/049889

PCT Pub. Date: Jun. 17, 2004

(65) Prior Publication Data

US 2006/0123748 A1 Jun. 15, 2006

(30) Foreign Application Priority Data

Dec. 3, 2002 (GB) ..... 0228148.3

(51) Int. Cl.
*B01D 45/12* (2006.01)

(52) U.S. Cl. ..... 55/345; 55/428; 55/429; 55/459.1; 55/DIG. 3

(58) Field of Classification Search ..... 55/345, 55/428, 429, 459.1, DIG. 3
See application file for complete search history.

(56) References Cited

U.S. PATENT DOCUMENTS 5,078,761 A 1/1992 Dyson
5,125,127 A 6/1992 Bach et al.

(Continued)

FOREIGN PATENT DOCUMENTS

DE 38 34 686 C1 12/1989

(Continued)

OTHER PUBLICATIONS

Pending U.S. Appl. No. 11/187,414, filed Jul. 22, 2005, 23 pages.

(Continued)

*Primary Examiner*—Robert A Hopkins
(74) *Attorney, Agent, or Firm*—Michael Best & Friedrich LLP

(57) ABSTRACT

A dust separating and collecting apparatus for a suction cleaner comprising at least one cyclonic separating device (10) having a body (12) through which a stream of air with dust therein can be caused to flow by a suction unit from an air inlet (16) to an air outlet (18) of the device, said inlet and outlet being at or adjacent one end of the body and said separating device further having a lateral outlet (20) at or adjacent the other end of the body for dust separated from the airstream in the course of its passage through the separator; and a receptacle (34) for the separated dust, the receptacle being movably disposed alongside said separating device (10) and having an inlet (42) for separated dust communicating with the dust outlet (20) of the separating device. Preferably there are two cyclonic separating devices (10, 11) and the receptacle (34) lies generally between them.

17 Claims, 10 Drawing Sheets

U.S. PATENT DOCUMENTS

| | | | | |
|---|---|---|---|---|
| 5,135,552 | A | 8/1992 | Weistra | |
| 5,351,362 | A | 10/1994 | Kramer et al. | |
| 5,500,979 | A | 3/1996 | Wörwag | |
| 5,960,514 | A | 10/1999 | Miller et al. | |
| 6,058,559 | A | 5/2000 | Yoshimi et al. | |
| 6,350,292 | B1 | 2/2002 | Lee et al. | |
| 6,572,668 | B1 | 6/2003 | An et al. | |
| 6,662,403 | B2 | 12/2003 | Oh | |
| 6,706,095 | B2 * | 3/2004 | Morgan | 95/268 |
| 6,896,720 | B1 * | 5/2005 | Arnold et al. | 95/271 |
| 2002/0011053 | A1 | 1/2002 | Oh | |
| 2002/0062632 | A1 | 5/2002 | Oh | |
| 2002/0088078 | A1 | 7/2002 | Oh et al. | |
| 2002/0120998 | A1 | 9/2002 | Dubos et al. | |
| 2002/0124538 | A1 | 9/2002 | Oh et al. | |
| 2003/0106182 | A1 | 6/2003 | Lee | |
| 2003/0106183 | A1 | 6/2003 | Frederick et al. | |

FOREIGN PATENT DOCUMENTS

| | | | |
|---|---|---|---|
| DE | 94 20 797.6 | U1 | 7/1995 |
| DE | 299 00 460 | U1 | 8/2000 |
| DE | 199 14 574 | C1 | 11/2000 |
| DE | 10153898 | A1 | 8/2002 |
| DE | 101 10 771 | A1 | 9/2002 |
| EP | 489468 | A1 | 6/1992 |
| EP | 1 386 573 | A2 | 2/2004 |
| FR | 2 425 227 | | 12/1979 |
| GB | 2 128 075 | A | 4/1984 |
| GB | 2 367 510 | A | 4/2002 |
| GB | 2370980 | A | 7/2002 |
| WO | WO 98/35602 | A1 | 8/1998 |
| WO | WO 2004/049887 | A1 | 6/2004 |
| WO | WO 2004/049890 | A1 | 6/2004 |
| WO | WO 2004/052166 | A1 | 6/2004 |

OTHER PUBLICATIONS

Pending U.S. Appl. No. 11/217,584, filed Aug. 31, 2005, 17 pages.
Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,537, filed Nov. 10, 2005, 21 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/273,094, filed Nov. 14, 2005, 17 pages.
Pending U.S. Appl. No. 11/329,194, filed Jan. 10, 2006, 23 pages.
Pending U.S. Appl. No. 11/375,722, filed Mar. 15, 2006, 16 pages.
Examination report for Australian application No. 2003285553, dated Dec. 21, 2006, 7 pages.
Examination report for Indian application No. 2639/DELNP/2005, dated May 8, 2007, 2 pages.
Examination report for Russian application No. 20050120732, dated Jun. 26, 2006, 4 pages.

* cited by examiner

DUST SEPARATOR AND COLLECTOR ARRANGEMENT FOR SUCTION CLEANER

DESCRIPTION OF INVENTION

This invention relates to an arrangement of dust separating and collecting apparatus for use in a suction cleaner.

Suction cleaners ("vacuum cleaners"), of the kind in which dust (which expression as used herein includes other debris) is picked up by suction and entrained in an airflow, the dust subsequently being separated from the airflow by a separating means and retained for subsequent disposal, are well known. The separating means may include one or more cyclonic separators in which the dust is separated from the airflow by centrifugal force and/or one or more filters. Traditionally suction cleaners using filters as the separating means have included as part of a filter system a reusable or disposable bag in which the separated dust is collected: this facilitates disposal of collected dust since the bag can be removed from the cleaner and taken to where it can be emptied of its contents or simply thrown away. More recently so-called "bagless" cleaners incorporating a cyclonic separating assembly have appeared; such a cyclonic separator assembly may include one or more cyclonic separating stages and possibly a filter element which removes any fine dust particles still entrained in the airflow after the airflow has passed through the cyclonic separation stage or stages. In these the most common arrangement for dust collection has been for the dust to collect in a lower part of the cyclonic separator assembly. The most common arrangement has been for all or part of the separator assembly to be removable from the cleaner for disposal of dust collected therein. There have been cyclonic separator assemblies with parts in which dust collects removable therefrom so that the whole assembly does not have to be removed from the cleaner when collected dust is to be emptied, but even so in many cases this has necessitated the movement of a large component or assembly in relation to the cleaner in order to permit removal of the dust-collecting part.

It is broadly the object of the present invention to provide for convenient removal of collected dust from a cleaner incorporating a separator assembly which includes at least one cyclonic separation device.

According to one aspect of the present invention, we provide a dust separating and collecting apparatus for a suction cleaner, the apparatus comprising:

at least one cyclonic separating device comprising a body through which a stream of air with dust therein can be caused to flow by a suction unit from an air inlet to an air outlet of the device, said inlet and outlet being at or adjacent one end of the body and said separating device further having a lateral outlet at or adjacent the other end of the body for dust separated from the airstream in the course of its passage through the separator; and a receptacle for the separated dust, the receptacle being movably disposed alongside said separating device and having an inlet for separated dust communicating with the dust outlet of the separating device.

Preferably there is sealing means operative between the separating device and receptacle at said inlet of the latter, to prevent escape of dust therebetween.

The sealing means may comprise an element, e.g. in bellows configuration, of a flexible and resilient material such as a rubber or plastics material. Such a sealing means is able to accommodate production and installation tolerances in the separating device and the dust receptacle, and prevent escape of dust therebetween.

The cyclonic separating device, which separates entrained dust from the stream of air therethrough by centrifugal force, may include a part which is of circular section and may taper, and the dust outlet therefrom may extend tangentially thereof.

According to another aspect of the invention we provide a dust separating and collecting apparatus for a suction cleaner, the apparatus comprising:

first and second cyclonic separating devices each comprising a body through which a stream of air with dust therein can be caused to flow by a suction unit from an air inlet to an air outlet of the device, the first and second separating devices being arranged successively with the air outlet of the first device communicating with the air inlet of the second device;

each separating device having a lateral outlet for dust separated from the airstream in the course of its passage through the separator; and a receptacle for the separated dust, the receptacle being movably disposed alongside said separating devices and adapted to receive separated dust from the dust outlets of the separating devices.

The first device may remove large dust particles from the stream of air and the second device remove particles remaining in the stream, which will usually be finer particles. In this case the dust receptacle may comprise respective inlets for separated dust, communicating with respective dust outlets from the two separators.

The separating devices may be arranged so that the receptacle or part thereof can occupy a space generally between them. For example, as in the embodiment described hereafter and shown in the drawings, the separating devices may be spaced laterally from one another and their axes (about which helical airflow occurs therein to cause separation of dust from the stream of air) may be more or less parallel to one another. In this case, the receptacle for separated dust may lie generally between the separating devices with its respective inlets for registering with the outlets from the two separators facing away from one another on opposite sides of the receptacle.

In an alternative arrangement of the separating devices they may be arranged with their axes inclined, e.g. more or less perpendicular, to one another. The receptacle for separated dust may then lie generally in a space partly bounded by the separating devices, with the respective inlets of the receptacle facing in appropriate directions to receive dust from the outlets therefor of the separating devices.

To ensure no undesired flow of air occurs between the two separators, the receptacle may be internally divided, by a partition or partitions, into respective parts for receiving the dust separated by the two separating devices.

Since in a cyclonic separation apparatus having first and second separation stages it will usually be the case that most of the entrained dust, particularly large particles and other debris, is separated by the first separating device leaving only a lesser quantity of mostly fine dust to be separated by the second separating device, the part of the receiver which receives dust from the first separating device may be substantially larger than that which receives dust from the second separating device.

The inlet or at least one of the inlets to the receptacle may have an entry passage shaped so as to resist any tendency for dust to pass back from the receptacle to the separating device(s). This entry passage may comprise a duct extending into the interior of the receptacle from a wall thereof.

According to a further aspect of the invention, we provide a suction cleaner including a dust separating and collecting apparatus according to the first aspect of the invention as set forth in any of the above paragraphs.

The cleaner may be of the "cylinder" type in which a cleaning head for picking up dust is connected to the cleaner, which houses a suction-creating unit and the dust separating and collecting apparatus, by a flexible hose and possibly a rigid wand.

First and second cyclonic separating devices are preferably disposed in a casing of the cleaner to each side thereof, with the dust receptacle therebetween. The dust receptacle may be removable from the cleaner upwardly thereof, having regard to the normal intended orientation of the cleaner when in use.

These and other aspects of the invention will now be described by way of example with reference to the accompanying drawings, of which:

Figure 1:
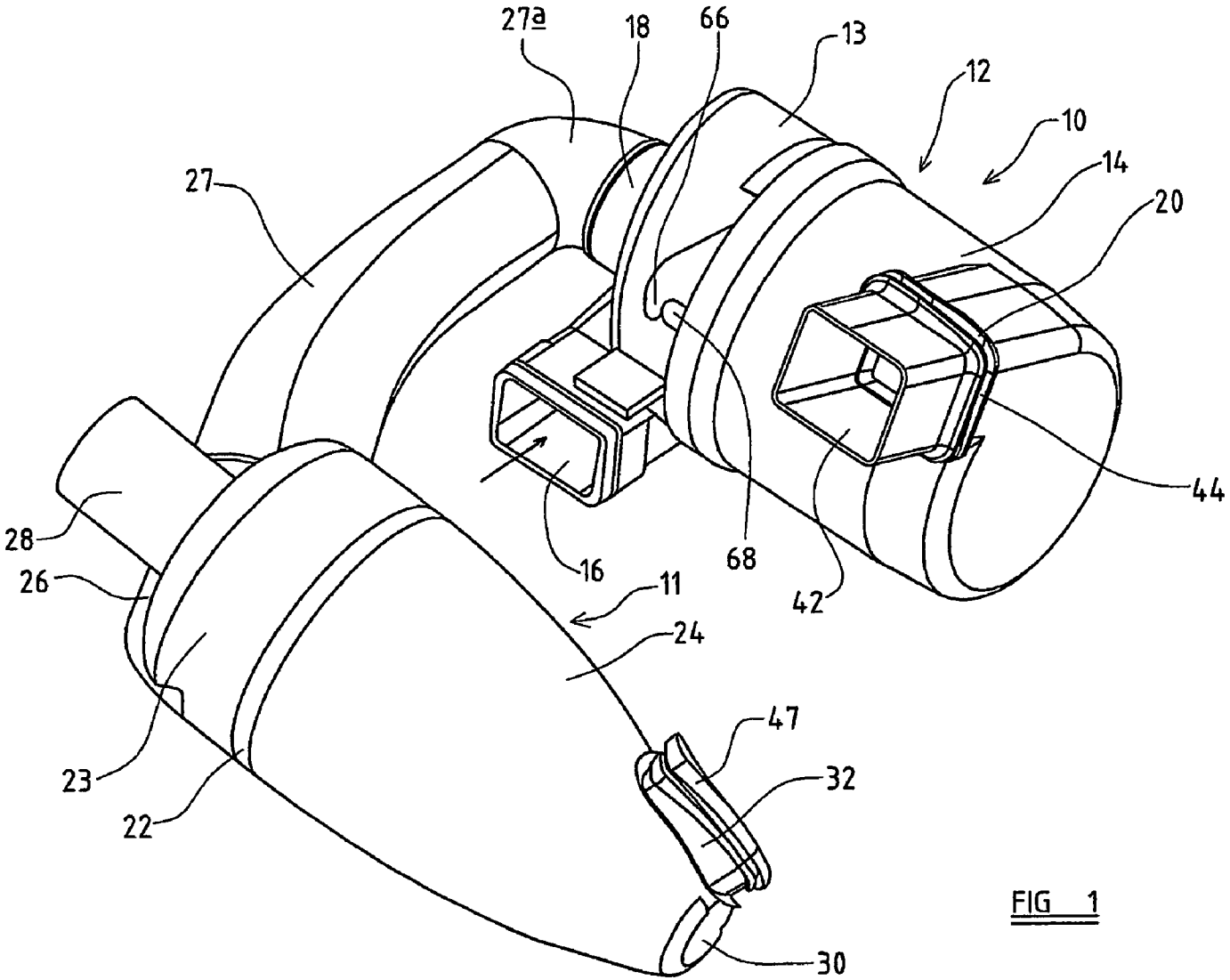
FIG. 1 is a diagrammatic perspective view showing an embodiment of dust separating apparatus in accordance with the invention.
Figure 2:
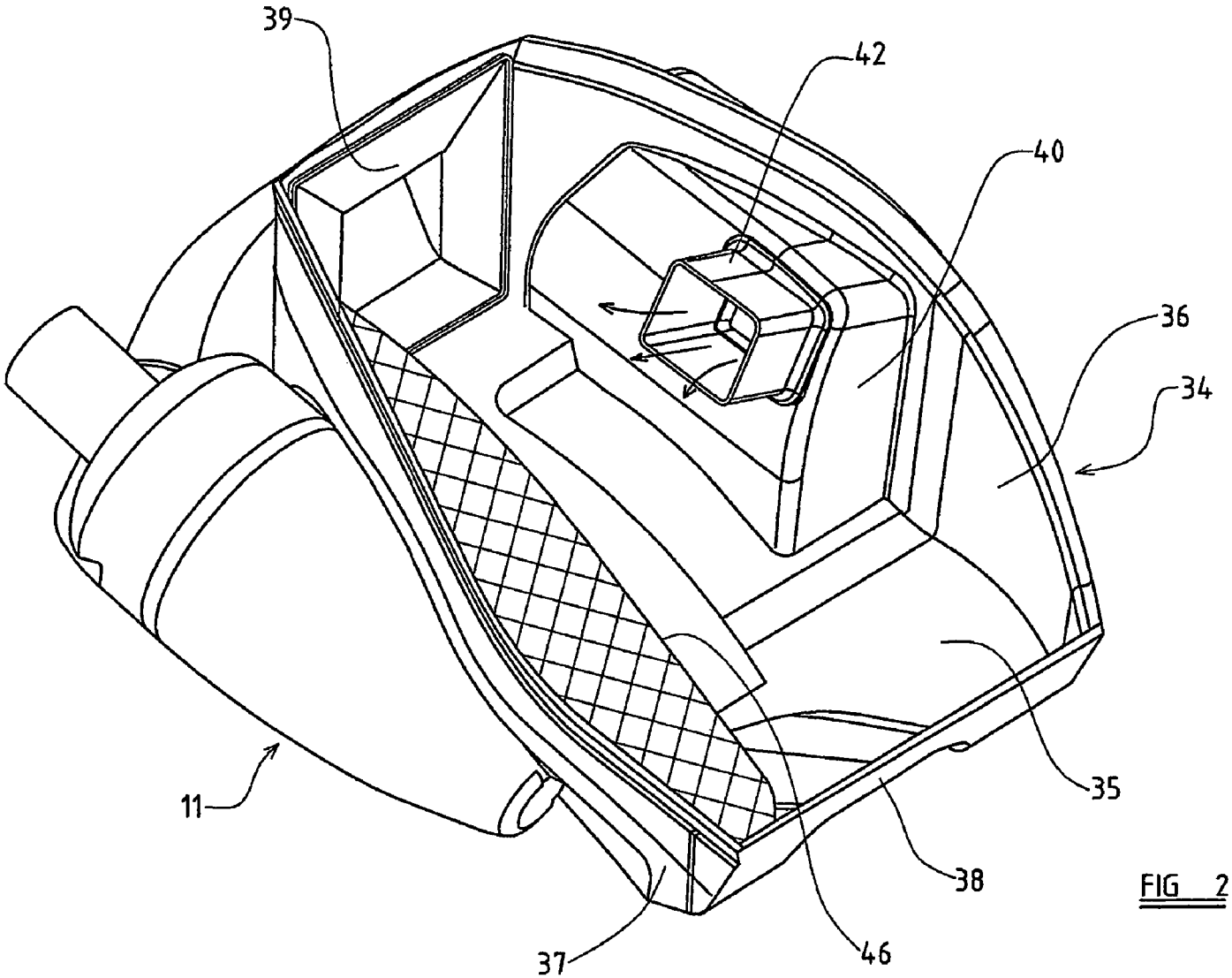
FIG. 2 is a perspective view as FIG. 1 showing the apparatus with a dust receptacle therebetween.
Figure 3:
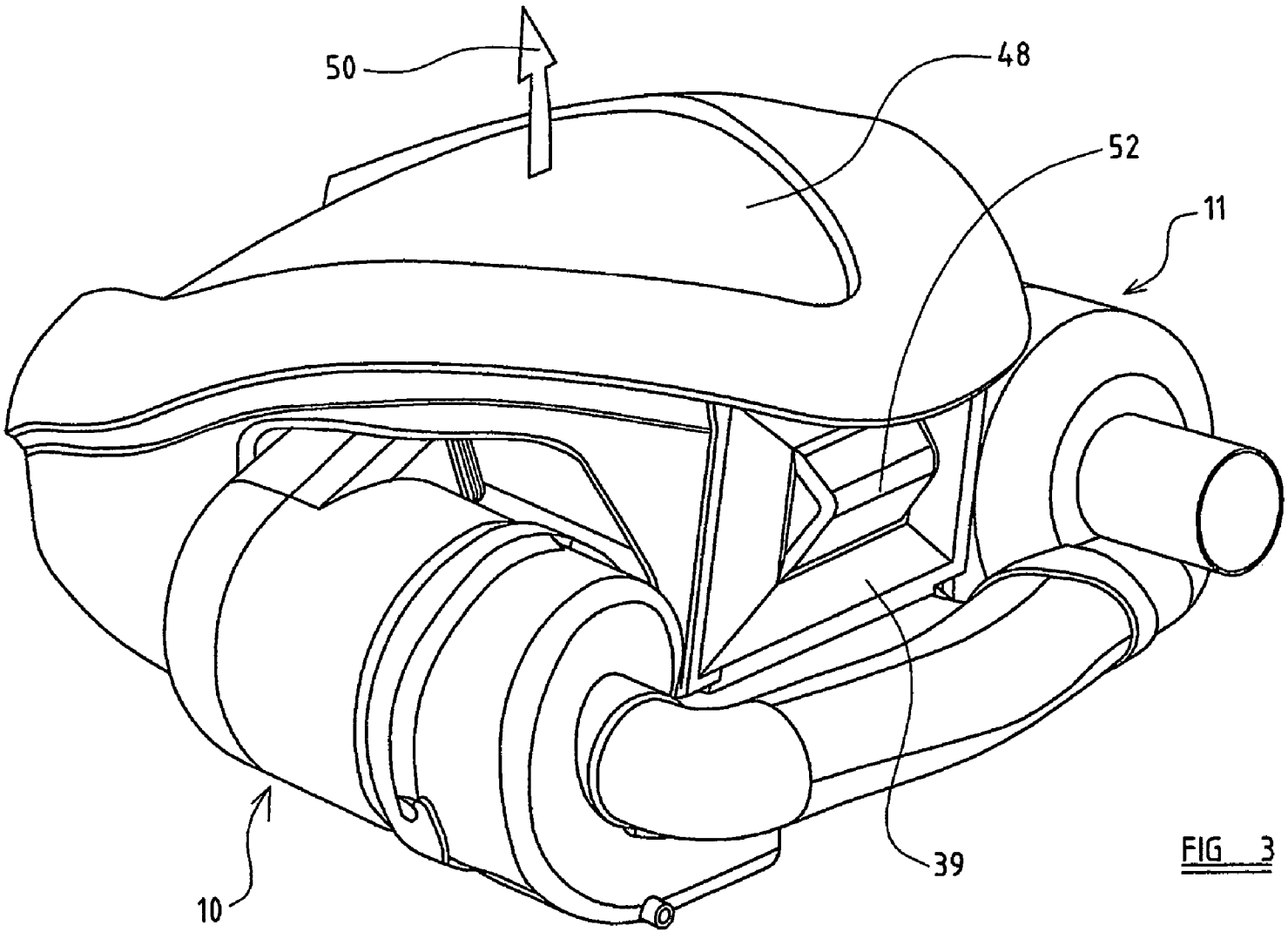
FIG. 3 is a view as FIG. 2 but from a different perspective viewpoint, illustrating the manner of removal of the dust receptacle.

Referring firstly to FIGS. 1 to 3 of the drawings, these show a dust separating apparatus in accordance with the invention, for use in a suction cleaner. FIGS. 2 and 3 show, in association with the separating apparatus, a receptacle for dust and other debris separated from the stream of air established by the cleaner when operating.

The separating apparatus comprises a first cyclonic separator indicated generally at 10 and a second cyclonic separator indicated generally at 11. Each of the separators is a cyclonic separating device, in which air flows in a stream from an air inlet to an air outlet and is caused to flow in a helical vortex within the separator, which causes entrained dust particles to be separated from the airstream by centrifugal force. Cyclonic separators in suction cleaners are well known. The axis about which such flow in a vortex takes place is called herein the axis of the separator, and terms such as axially, tangentially and so on make reference to such axis.

The first separator 10 comprises a body 12 with a first body part 13 and a second body part 14. The body 12 is generally cylindrical, of circular cross-sectional shape and more or less constant cross-sectional area along its length. The body part 13 has a tangentially oriented air inlet 16 for a stream of air with dust entrained therein. This will have been picked up at a cleaning head of the cleaner, connected thereto, e.g. by a flexible hose and rigid wand. The nature of the connection to the cleaning head is irrelevant to the present invention. The body part 13 further has a centrally disposed axially extending outlet 18 for the stream of air. The body part 14 has, at its end remote from the body part 13, a tangentially oriented lateral outlet opening 20 for dust separated from the stream of air by centrifugal force in the course of its flowing in a vortex between the inlet 16 and outlet 18 of the separator 10.

The second separator 11 comprises a body 22 with a first body part 23 and second body part 24. The body part 23 has a tangentially and slightly helically inclined inlet 26 for the stream of air which it receives from the outlet 18 of the first separator 10 by way of a connecting elbow 27*a* and duct 27. An outlet for the airstream extends axially through the centre of the body part 23 and is indicated at 28. This is arranged to be connected by suitable ducting to a suitable motor-driven fan in a suction cleaner, with a filter arranged in such connection to trap any dust particles not separated from the airstream by the separators 10, 11. The body part 24 of the separator 11 is of tapering configuration so that its end 30 remote from the body part 23 is of much smaller diameter than the latter. Adjacent its end 30 there is a lateral outlet opening 32 for dust separated from the airstream by centrifugal force within the body 22 of the separator 11.

The axes of the separators 10, 11 are more or less parallel to one another. When installed in a suction cleaner a dust receptacle 34 is disposed generally in the region between the two separators 10, 11 for receiving dust separated from the airstream by the two separators. FIG. 2 shows that the dust receptacle 34 comprises a base 35, side walls 36, 37 and end walls 38, 39 defining an interior space for receiving dust from the separators and retaining it for disposal. Wall 36 has an inset part 40 (in which the separator 10 is partially accommodated) and in this inset part there is an inlet 42 for dust separated in the first separator 10 and discharged at the outlet opening 20 thereof, the inlet 42 to the dust receptacle including a short tube 42 reaching into the interior volume of the receptacle 34: this helps ensure that the dust is retained in the receptacle. The inlet tube 42 is shown in FIG. 1 in its operative disposition registering with the outlet opening 20 of the separator 10: also visible is a flexible seal, e.g. of bellows type, 44 preventing leakage of air and dust between the separator 10 and dust receptacle 34 when the dust receptacle is in position.

On the opposite side of the receptacle 34 a partition wall 46 defines an internal compartment within the receptacle which is separated from the main internal volume thereof. This secondary compartment has an inlet opening which registers with the outlet 32 from the second separator 11 so that the secondary compartment can receive dust separated from the airstream by the second separator. A flexible seal operative between the separator 11 and the dust receptacle is shown in FIG. 1 at 47, around the end of the dust outlet 32 of the separator 11 and abutting the dust receptacle when the latter is in position, to prevent leakage of dust and air between the separator 11 and dust receptacle.

FIG. 3 is a perspective view from the opposite direction to that of FIGS. 1 and 2, showing the dust receptacle in position and also showing a cover 48 for the dust receptacle closing the top thereof which is shown open in FIG. 2. The cover 48 is intended, in a suction cleaner, to form part of the visible exterior casing of the suction cleaner, and hence is styled for compatibility with the rest of the suction cleaner casing. For disposal of dust collected in the dust receptacle, the receptacle as a whole is lifted away from the separators in the direction indicated by arrow 50 so that it can be taken to a suitable place for emptying and disposal. For such emptying, the end wall 39 of the receptacle may open pivotally from its normal position in which it is held by a latching device.

Also visible in FIG. 3 is a latching formation 52 on the end wall 39 of the dust receptacle, which forms part of the mechanism for retaining the dust receptacle in position in the cleaner.

Figure 4:
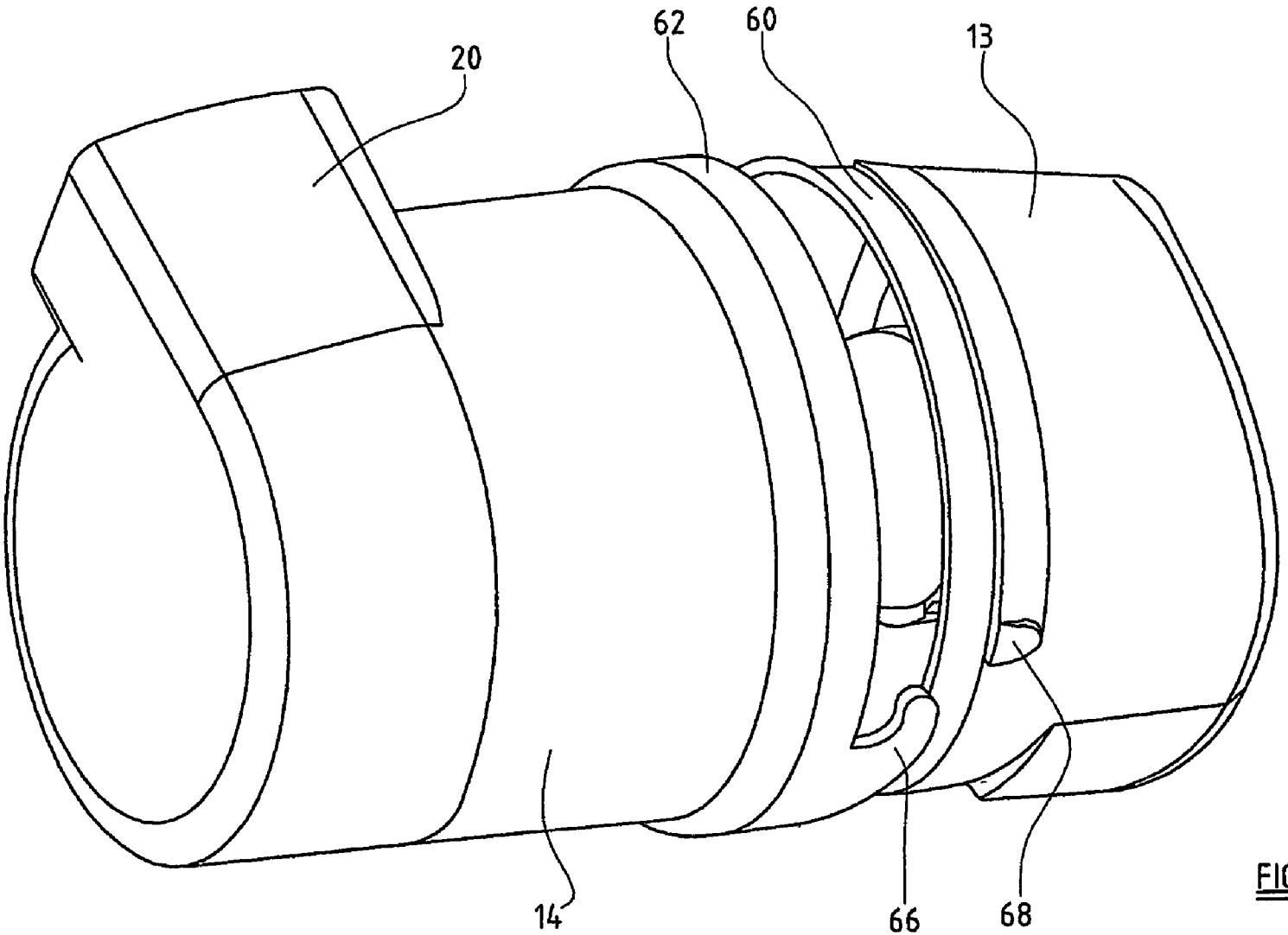
FIG. 4 is a perspective view of one of the separating devices, showing removal of a part of the body thereof.
Figure 5:
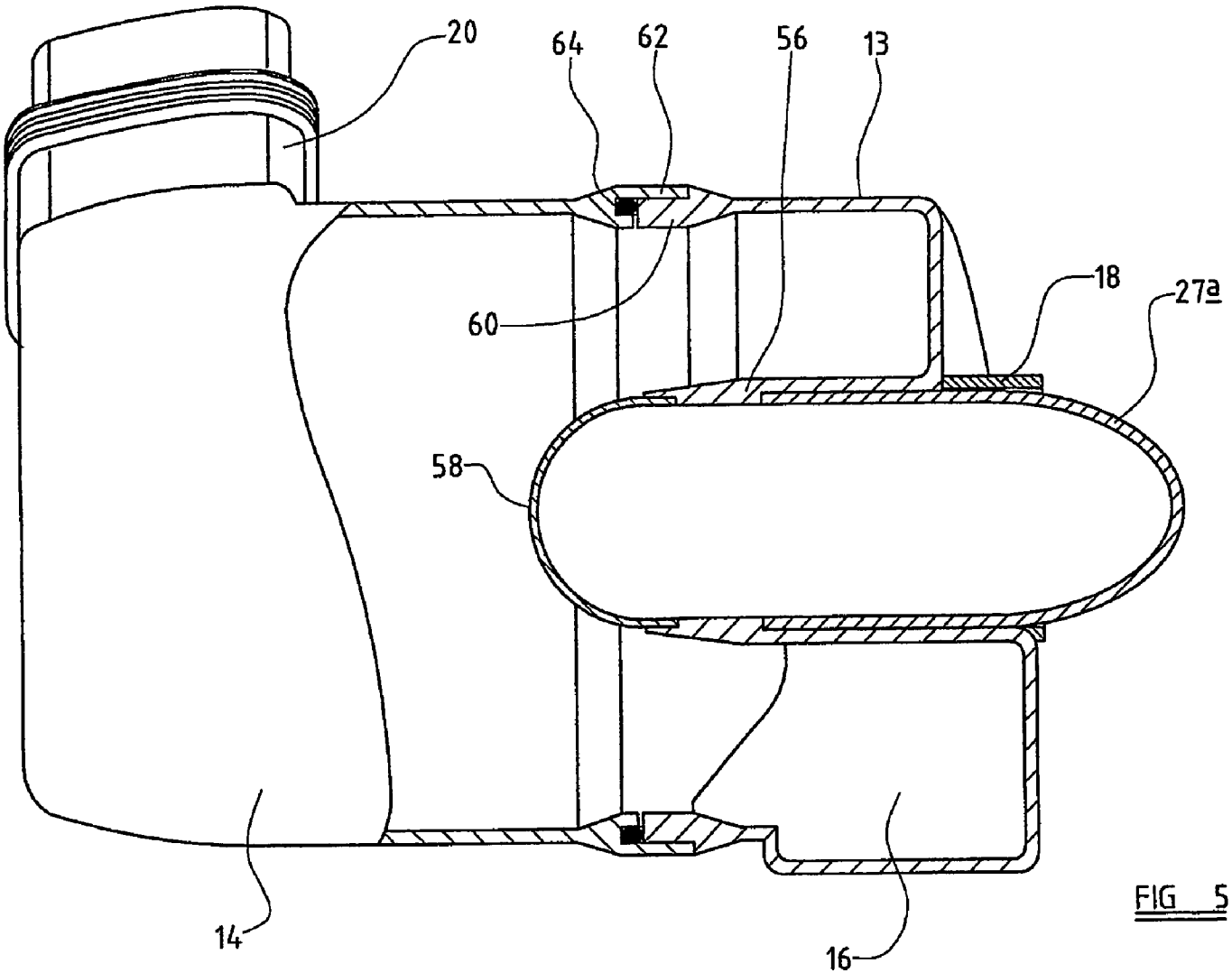
FIG. 5 is a section through the separating device of FIG. 4.
Figure 6:
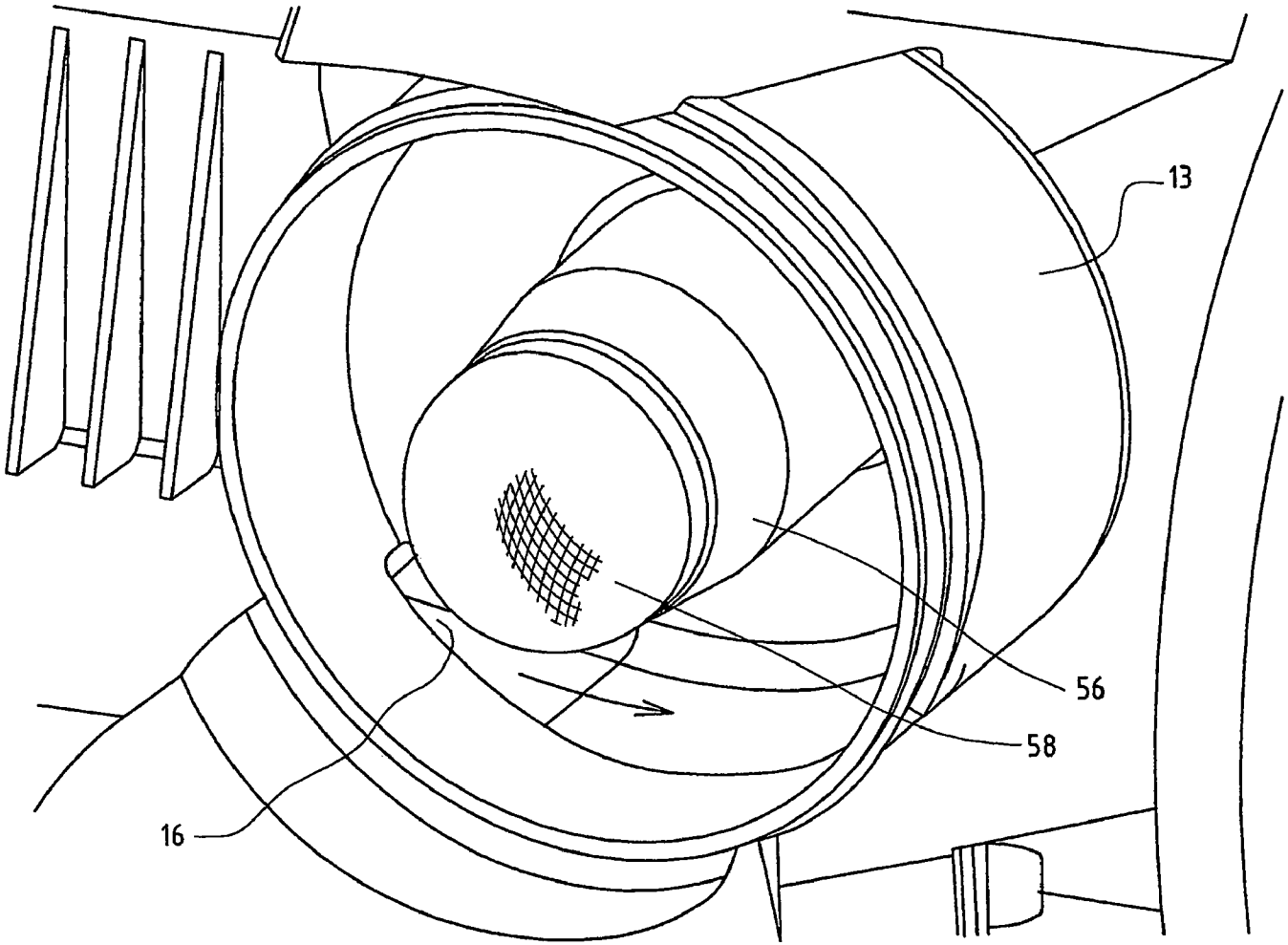
FIG. 6 is a perspective view of the interior of one part of the separating device.

Referring now to FIGS. 4, 5 and 6, these show the separator 10 in greater detail. FIGS. 5 and 6 show the interior of the body part 13 with the tangentially extending inlet 16 for dust-laden air, and, in the centre of the body part, the outlet duct 18 of which a portion 56 extends into the body part along the central axis of the separator. The part 56 is provided at its free end within the separator with a domed wire gauze element 58 which acts as an extremely coarse filter to ensure that large pieces of debris remain within the separator 10 and do not pass to the second separator 11 by way of the connecting elbow 27*a* and duct 27. Also clearly shown in FIGS. 4 and 5 is the body part 14 of the separator 10 with its tangential outlet opening 20.

The body part 13 has at its free end an annular spigot 60 which fits closely within a complementary sleeve 62 at the facing end of the body part 14. A flexible seal 64 in the form of an O-ring is accommodated in an annular recess at the base of the sleeve 62, to provide an airtight seal between the body parts 13, 14. The body part 14 is provided with two hook-like latching formations 66 which are diametrically opposite one another relative to the body part, and these are engageable with lugs 68 similarly disposed on the body part 13. Thus a "bayonet connection" is afforded between the two body parts: the body part 14 is removable from the body part 13 by firstly an angular movement of the former to disengage the formations 66, 68 followed by axial movement of the body part 14 until it is clear of the body part 13. This facilitates access to the interior of the separator for cleaning or removal of any large items of debris which, having been picked up by the vacuum cleaner, are trapped in the separator 10 being unable to leave it by way of the dust outlet 20 or the airstream outlet 18. Refitting of the body part 14 to the part 13 is of course the reverse of the removal procedure.

Figure 7:
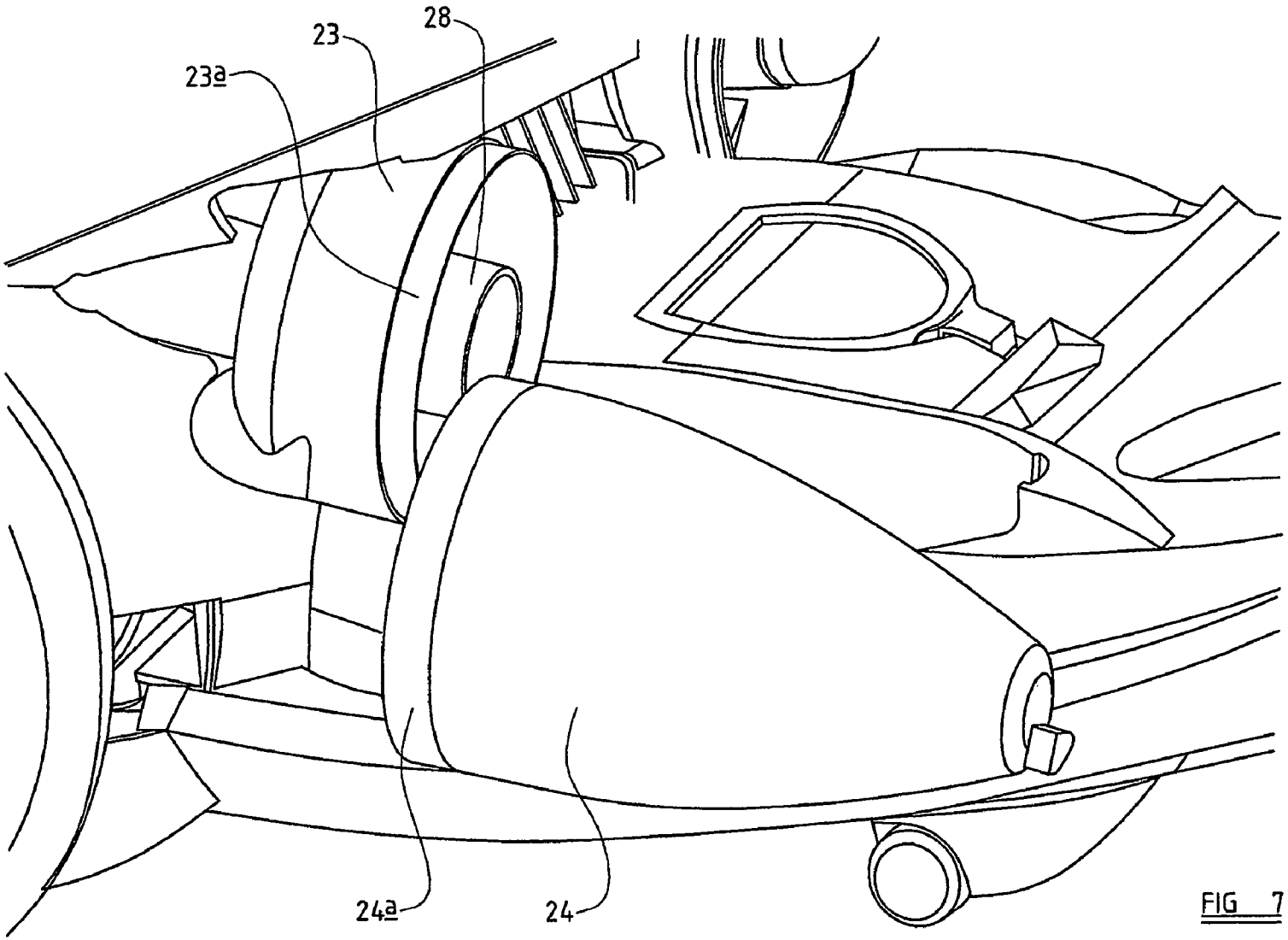
FIG. 7 is a perspective view showing removal of a part of the other separating device.

FIG. 7 shows the second separator 11 with its body part 24 removed from its body part 23. This enables the air outlet duct 28 in the interior of the body part 23 to be seen: it extends within the body of the separator to approximately the end of the body part 23. The body parts 23, 24 may fit together by a bayonet connection as described above in relation to the body parts 13, 14 of the first separator, or there may simply be frictional engagement between a spigot 23*a* at the free end of the body part 23 and a sleeve portion 24*a* at the facing end of the body part 24. A suitable seal is provided between the body parts 23, 24. It is envisaged that removal of the body part 24 of the second separator 11 is less likely to be required than is removal of the body part 14 of the first separator 10, since no large items of debris sufficient to interfere with the operation of the separator 11 should be able to reach the latter from the first separator. However, cleaning of the interior of the separator 11 may be required if damp plaster dust for example has been picked up by the suction cleaner.

Figure 8:
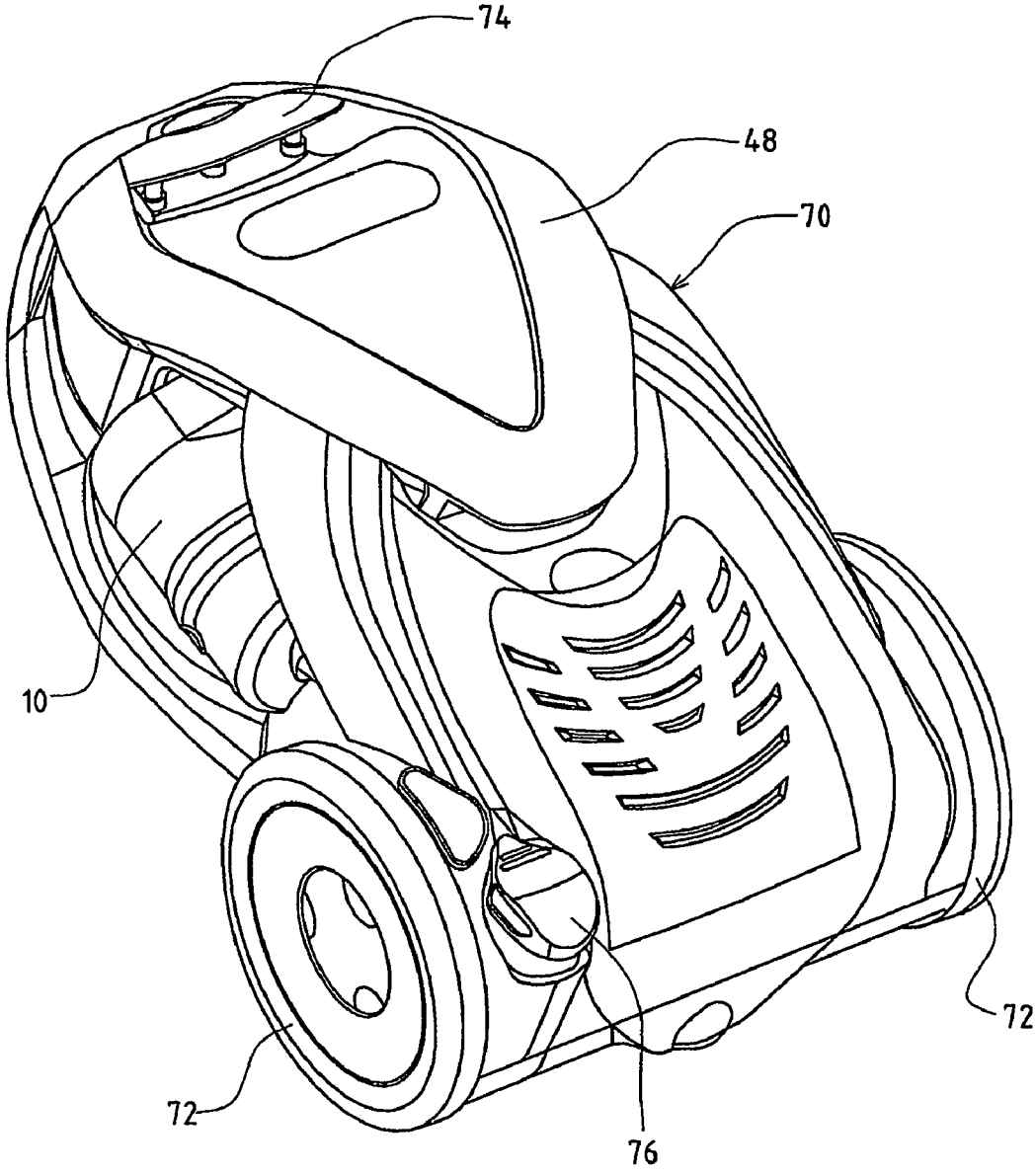
FIG. 8 is a perspective view of a suction cleaner showing the separating apparatus therein.

FIG. 8 of the drawings shows diagrammatically a suction cleaner having the above described separator and dust receptacle arrangement incorporated therein. It is a cleaner of the "cylinder" type, in which a flexible hose and optionally a rigid wand are used to connect a cleaning head to the cleaner, the cleaning head being able to be moved over a surface being cleaned to pick up dust. The cleaner comprises a body with an external casing 70, having at one end a pair of wheels 72 on which, together with a further wheel or castor (not shown) underneath the casing 70 towards the opposite end thereof from the wheels 72, it can be moved over a floor surface. The cover 48 of the dust receptacle is shown and it will be noted that the configuration thereof forms part of the styling of the cleaner. Also shown in FIG. 8 is a handle 74 by which the dust receptacle may be carried when it has been removed from the cleaner for disposal of dust collected therein. Separator 10 is visible in FIG. 8, and it will be appreciated that the separator 11 is correspondingly positioned at the opposite side of the dust receptacle. An electric motor, fan for causing the required airstream in the cleaner, and such further filters as may be required are provided in the part of the casing generally between the wheels 72. Also there is a cable storage reel from which an electrical power cable having a plug 76 at its free end may be deployed for connection to a mains socket outlet, and to which the cable may be retracted after use.

Figure 9:
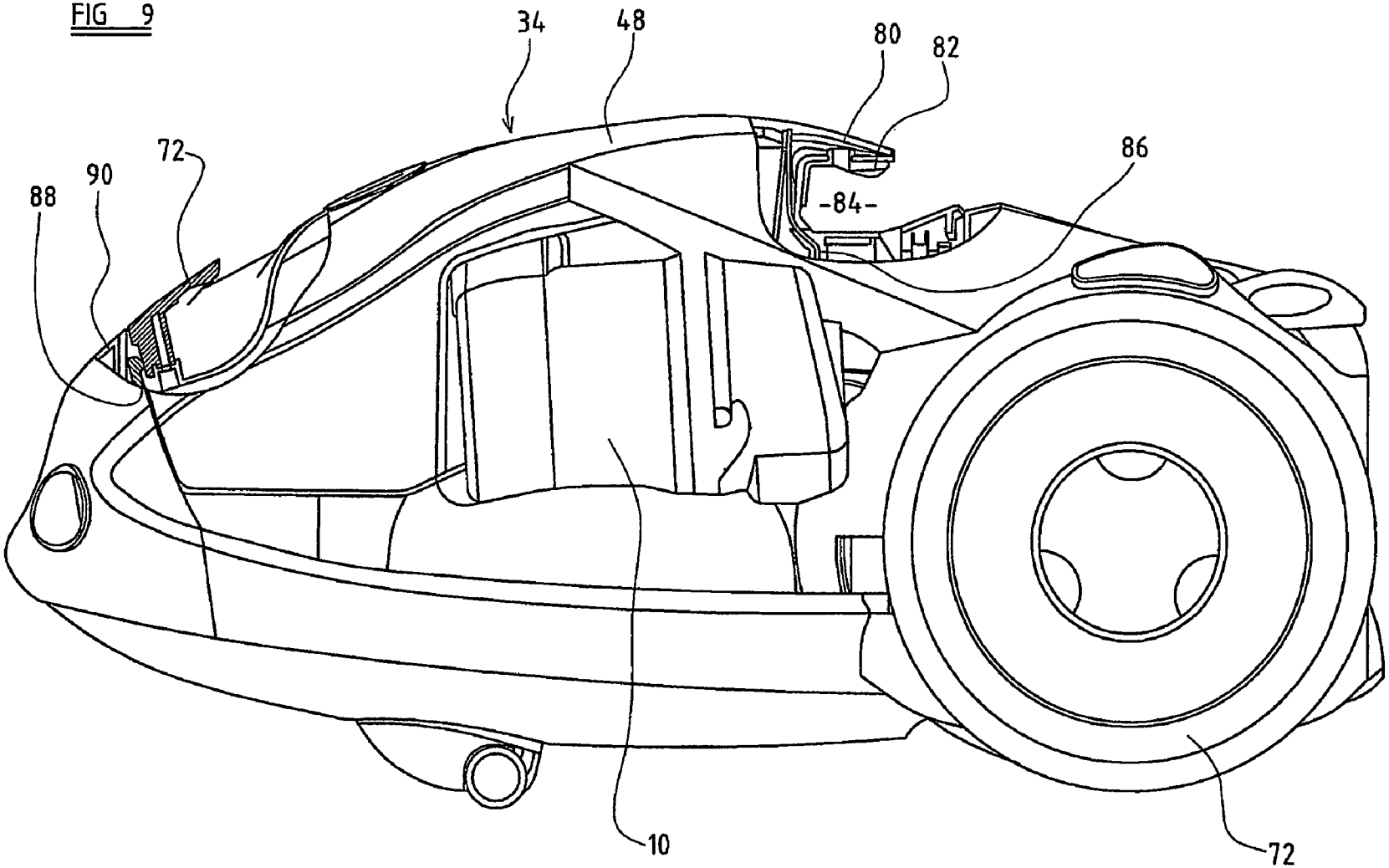
FIG. 9 is a side view of the cleaner as FIG. 8.

FIGS. 8 and 9 of the drawings show that the dust receptacle 34 and in particular its top cover 48 has a portion 80 which fits over a part 82 of the casing of the cleaner which acts as a carrying handle for the cleaner and affords beneath it a recess 84 able to receive part of the hand of a person carrying the cleaner. Adjacent the recess 84 the casing of the cleaner affords a formation 86 with which the formation 52 on the end wall 39 of the dust receptacle cooperates. At the opposite end of the dust receptacle where the carrying handle 72 for the receptacle is provided, a spring biased latch member 88 operable by a release button 90 cooperates with a formation on the dust receptacle in the vicinity of the handle 74 thereof.

Figure 10:
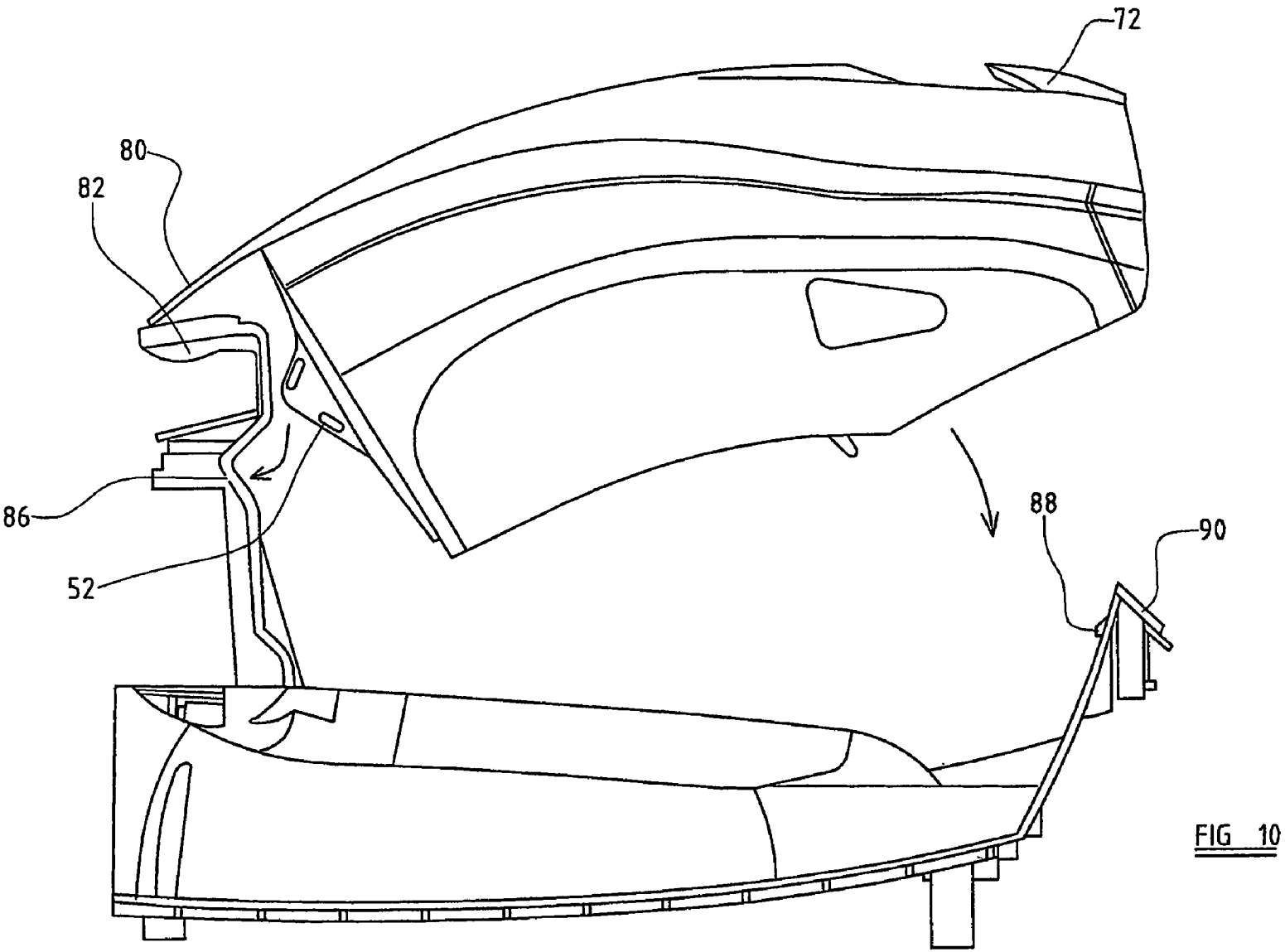
FIG. 10 is a partial side view, illustrating removal of the dust receptacle from the cleaner.

Release of the dust receptacle from the cleaner for disposal of dust accumulated therein is illustrated in FIG. 10. Release of the latch 88 by operation of button 90 enables the bin to be lifted by its handle 74 with a pivoting motion, disengaging the formation 52 from the formation 86 until the bin is free to be removed. After emptying, the bin is reattached to the cleaner by the reverse of the removal operation, until the latch 88 is engaged therewith and it is again firmly secured to the body of the cleaner.

Although in the above described embodiment the separators 10, 11 have their axes oriented generally parallel to one another, they may alternatively be in some other orientation. For example their axes may be generally perpendicular to one another and in this case the airstream outlet of the first separator may lead directly into the inlet of the second separator, tangentially thereof. A dust receptacle, with respective inlets oriented to register with the outlets of the separators, may then lie generally in a space partly bounded by the two separators.

Although the invention is described above in relation to a cleaner of the cylinder type, it is to be understood that in principle it is also applicable to a cleaner of the "upright" type.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A dust separating and collecting apparatus for a suction cleaner, the apparatus comprising:

a. at least one cyclonic separating device comprising a body through which a stream of air with dust therein can be caused to flow by a suction unit from an air inlet to an air outlet of the device, said inlet and outlet being at or adjacent one end of the body and said separating device further having a lateral outlet at or adjacent the other end of the body for dust separated from the airstream in the course of its passage through the separator: and b. a single receptacle (34) for the separated dust, the receptacle (34) being movably disposed alongside said separating device (10, 11) and having an inlet (42) for separated dust communicating with the dust outlet (20, 32) of the separating device (10, 11), the receptacle being selectively attachable to the separating device to receive separated dust during operation and removable from the separating device to empty the separated dust from the receptacle.

2. Apparatus according to claim 1 further comprising sealing means operative between the separating device and receptacle at the inlet of the latter, to prevent escape of dust therebetween.

3. Apparatus according to claim 2 wherein said sealing means comprises an element of a rubber or plastics material.

4. Apparatus according to claim 1 wherein said separating device includes a part of circular section and said dust outlet extends generally tangentially thereof.

5. A dust separating and collecting apparatus for a suction cleaner, the apparatus comprising:

first and second cyclonic separating devices each comprising a body through which a stream of air with dust therein can be caused to flow by a suction unit from an air inlet to an air outlet of the device, the first and second separating devices being arranged successively with the air outlet of the first device communicating with the air inlet of the second device;

wherein each separating device having has a lateral outlet for dust separated from the airstream in the course of its passage through the separator; and a receptacle for the separated dust, the receptacle being movably disposed alongside said separating devices and adapted to receive separated dust from the dust outlets of the separating devices.

6. Apparatus according to claim 5 wherein at least one of said separating devices has its air inlet and air outlet provided at or adjacent one end of the body and its dust outlet at or adjacent the other end of the body.

7. Apparatus according to claim 6 wherein said at least one separating device includes a part of circular section and said dust outlet extends generally tangentially thereof.

8. Apparatus according to claim 5 wherein the dust receptacle comprises respective inlets for separated dust, communicating with respective dust outlets of the two separating devices.

9. Apparatus according to claim 8 wherein the, separating devices are arranged so that at least part of the receptacle can occupy a space generally between them.

10. Apparatus according to claim 9 wherein the separating devices are spaced laterally from one another and the receptacle for separated dust lies generally between the separating devices with its respective inlets for separated dust facing away from one another on opposite sides of the receptacle.

11. Apparatus according to claim 8 wherein the receptacle is internally divided into respective parts for receiving separated dust from the two separating devices.

12. Apparatus according to claim 11 wherein the part of the receptacle which receives dust from the first separating device is larger than that which receives dust from the second separating device.

13. Apparatus according to claim 8 wherein the inlet or at least one of the inlets to the receptacle has an entry passage shaped to resist any tendency for dust to pass back from the receptacle to the separating device(s).

14. Apparatus according to claim 13 wherein the entry passage comprises a duct extending into the interior of the receptacle from a wall thereof.

15. A suction cleaner according to claim 5 wherein first and second cyclonic separating devices are disposed in a casing of the cleaner to each side thereof with the dust receptacle therebetween.

16. A suction cleaner according to claim 15 wherein the suction cleaner is of the cylinder type.

17. A suction cleaner according to claim 16 wherein the dust receptacle is removable from the cleaner upwardly thereof when the cleaner is in its normal operative orientation.

* * * * *